US009715778B1

(12) United States Patent
Traeye

(10) Patent No.: US 9,715,778 B1
(45) Date of Patent: Jul. 25, 2017

(54) RANDOM NUMBER GENERATING DEVICE

(71) Applicant: Vincent Traeye, Fort Washington, MD (US)

(72) Inventor: Vincent Traeye, Fort Washington, MD (US)

( * ) Notice: Subject to any disclaimer, the term of this patent is extended or adjusted under 35 U.S.C. 154(b) by 0 days.

(21) Appl. No.: 15/152,559

(22) Filed: May 12, 2016

(51) Int. Cl.
*A63B 71/00* (2006.01)
*G07C 15/00* (2006.01)

(52) U.S. Cl.
CPC ..... *G07C 15/00* (2013.01)

(58) Field of Classification Search
CPC ..... G07C 15/00
See application file for complete search history.

(56) References Cited

U.S. PATENT DOCUMENTS

| | | | | |
|---|---|---|---|---|
| 93,501 | A * | 8/1869 | Treat | E05B 37/025 70/27 |
| 3,867,823 | A * | 2/1975 | Waltower | A45C 11/323 70/456 B |
| 4,541,630 | A | 9/1985 | Dirks | |
| 4,801,145 | A | 1/1989 | Arevalo | |
| 4,858,122 | A | 8/1989 | Kreisner | |
| 4,948,284 | A | 8/1990 | Lingott | |
| 5,118,110 | A | 6/1992 | Jones | |
| D377,373 | S | 1/1997 | Rebish | |
| RE36,192 | E | 4/1999 | Lee et al. | |
| D633,369 | S | 3/2011 | Atteridge et al. | |
| 9,464,460 | B2 * | 10/2016 | Lai | E05B 37/14 |

* cited by examiner

*Primary Examiner* — Michael Dennis

(57) ABSTRACT

A random number generating device for generating random number sequences for lottery games includes a cylinder that has opposing ends. A plurality of rings is rotationally coupled to the cylinder. Indicia are coupled to and arrayed linearly around an outer surface of each ring. Each ring is selectively rotatable around the cylinder, such that the rings are randomly positionable and wherein the indicia are arrayed in a plurality of parallel rows that extends between the opposing ends of the cylinder.

18 Claims, 3 Drawing Sheets

RANDOM NUMBER GENERATING DEVICE

BACKGROUND OF THE DISCLOSURE

Field of the Disclosure

The disclosure relates to number generating devices and more particularly pertains to a new number generating device for generating random number sequences for lottery games.

SUMMARY OF THE DISCLOSURE

An embodiment of the disclosure meets the needs presented above by generally comprising a cylinder that has opposing ends. A plurality of rings is rotationally coupled to the cylinder. Indicia are coupled to and arrayed linearly around an outer surface of each ring. Each ring is selectively rotatable around the cylinder, such that the rings are randomly positionable and wherein the indicia are arrayed in a plurality of parallel rows that extends between the opposing ends of the cylinder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
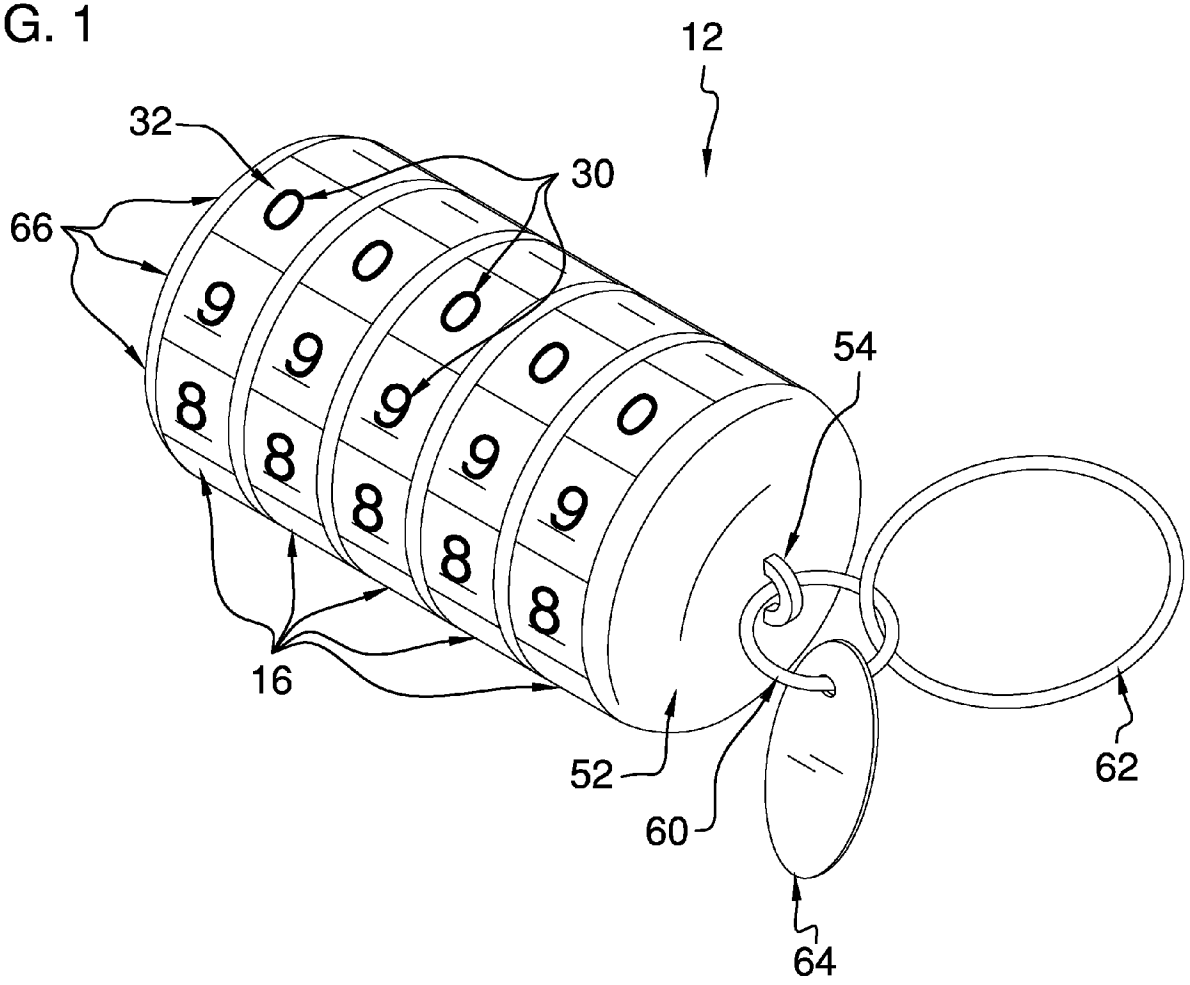
FIG. 1 is an isometric perspective view of a random number generating device according to an embodiment of the disclosure.
Figure 3:
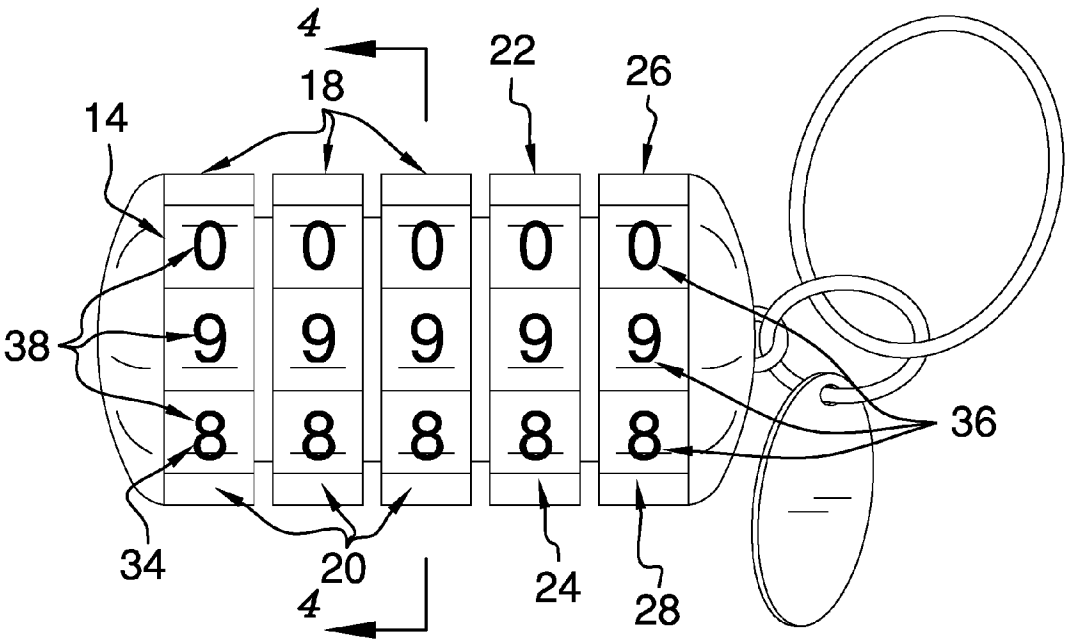
FIG. 3 is a side view of an embodiment of the disclosure.
Figure 2:
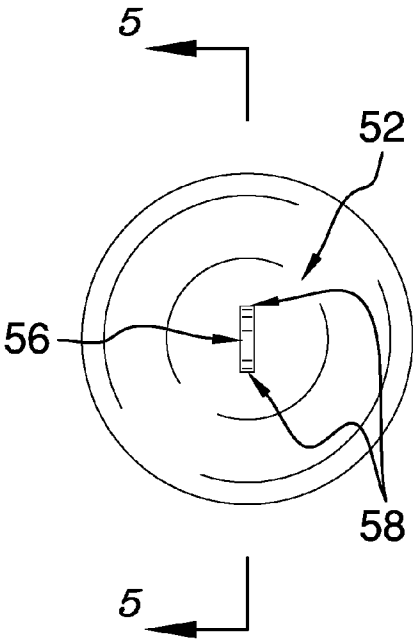
FIG. 2 is an end view of an embodiment of the disclosure.
Figure 5:
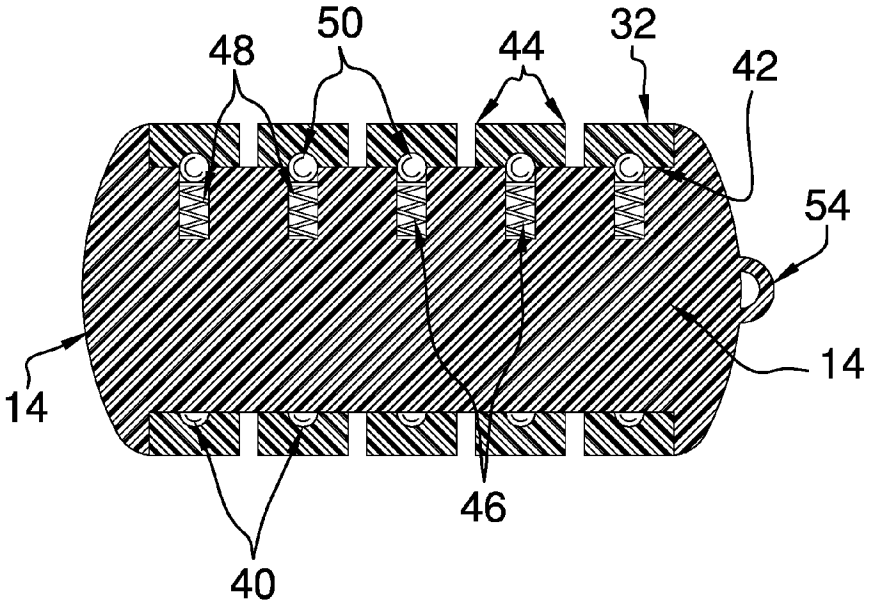
FIG. 5 is a cross-sectional view of an embodiment of the disclosure.
Figure 4:
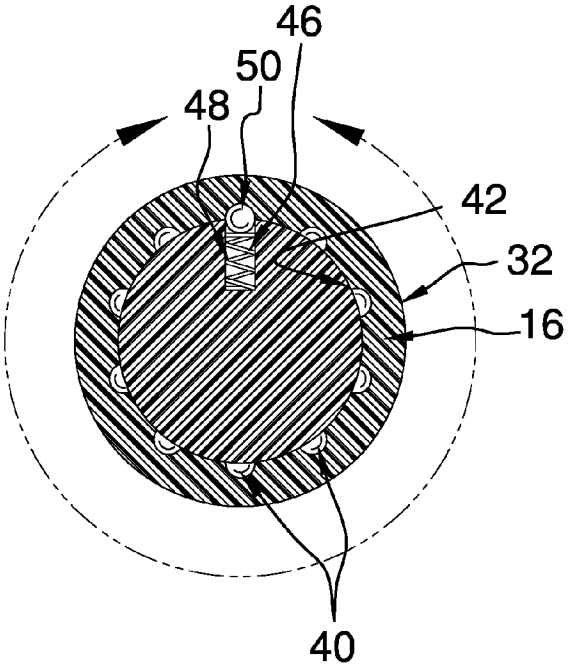
FIG. 4 is a cross-sectional view of an embodiment of the disclosure.

With reference now to the drawings, and in particular to FIGS. 1 through 5 thereof, a new number generating device embodying the principles and concepts of an embodiment of the disclosure and generally designated by the reference numeral 10 will be described.

As best illustrated in FIGS. 1 through 5, the random number generating device 10 generally comprises a cylinder 12 that has opposing ends 14. Each of a plurality of rings 16 is rotationally coupled to the cylinder 12. In one embodiment, the plurality of rings 16 comprises five rings 16. In another embodiment, the plurality of rings 16 comprises a set of three rings 18, a fourth ring 22 and a fifth ring 26. The set of three rings 18 is positioned sequentially adjacent to a respective opposing end 14 of the cylinder 12. The set of three rings 18 comprises a first color 20. The fourth ring 22 is positioned adjacent to the set of three rings 18. The fourth ring 22 comprises a second color 24. The fifth ring 26 is positioned between a respective opposing end 14 and the fourth ring 22. The fifth ring 26 comprises a third color 28. In another embodiment, the first color 20 is blue, the second color 24 is red and the third color 28 is yellow.

Indicia 30 are coupled to and arrayed linearly around an outer surface 32 of each ring 16. In one embodiment, the indicia 30 are engraved. In another embodiment, the indicia 30 comprise a fourth color 34. In yet another embodiment, the fourth color 34 is black.

Each ring 16 comprises a plurality of facets 36. The indicia 30 are coupled singly to each facet 36. Each plurality of facets 36 comprises ten facets 36. The indicia 30 that are coupled to each of the plurality of facets 36 consist of the set of numbers from zero to nine 38. Each set of numbers from zero to nine 38 is sequentially positioned on a respective plurality of facets 36.

Each of a plurality of indents 40 is positioned in an inner surface 42 of a respective ring 16. Each indent 40 is positioned substantially equally distant from opposing edges 44 of a respective ring 16. Each indent 40 is opposingly positioned relative to a respective facet 36. The indents 40 are semispherically shaped.

A plurality of channels 46 is positioned in the cylinder 12. The plurality of channels 46 is numerically equivalent to the plurality of rings 16. The channels 46 are circularly shaped when viewed longitudinally. The channels 46 are linearly positioned between the opposing ends 14 of the cylinder 12. Each channel 46 is selectively alignable with respective indents 40 positioned on a respective ring 16.

Each of a plurality of springs 48 is positioned in a respective channel 46. Each of a plurality of balls 50 is positioned between a respective spring 48 and a respective ring 16, such that the indents 40 reversibly couple to the balls 50 as the rings 16 are rotated around the cylinder 12.

A pair of caps 52 is coupled singly to each opposing end 14 of the cylinder 12. The caps 52 are substantially circumferentially complementary to the rings 16. The caps 52 are arcuate.

A coupler 54 is coupled to a respective cap 52. The coupler 54 is substantially centrally positioned on the respective the cap 52. The coupler 54 comprises a rod 56 that has opposing termini 58. Each opposing terminus 58 is coupled to the cap 52.

A hoop 60 is coupled to the coupler 54. The hoop 60 is circularly shaped. The hoop 60 is positioned through the coupler 54 such that the hoop 60 is configured for coupling to items of a user.

A key chain loop 62 is reversibly coupled to the hoop 60. The key chain loop 62 is configured for coupling to keys of the user.

A tag 64 is coupled to the hoop 60. The tag 64 is coupled to the hoop 60 such that the tag 64 is configured for labeling.

In use, each ball 50 is positioned in a respective channel 46 such that a respective spring 48 motivates the ball 50 into a respective indent 40 as a respective ring 16 is rotated around the cylinder 12. The respective ball 50 is reversibly coupled to the respective indent 40, such that each ring 16 is selectively rotatable around the cylinder 12. The rings 16 are randomly positionable, positioning the indicia 30 in a plurality of parallel rows 66 that extends between the opposing ends 14 of the cylinder 12. The user is presented with sequences of random numbers positioned in the parallel rows 66.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A random number generating device comprising:

a cylinder having opposing ends;

a plurality of rings rotationally coupled to said cylinder;

indicia coupled to and arrayed linearly around an outer surface of each said ring;

wherein each said ring is selectively rotatable around said cylinder, such that said rings are randomly positionable, wherein said indicia are arrayed in a plurality of parallel rows extending between said opposing ends of said cylinder;

each said ring comprising a plurality of facets, said indicia being coupled singly to each said facet;

a plurality of indents, each said indent being positioned in an inner surface of a respective said ring, each said indent being positioned substantially equally distant from opposing edges of said respective said ring, each said indent being opposingly positioned relative to a respective said facet, said indents being semispherically shaped;

a plurality of channels positioned in said cylinder, said plurality of channels being numerically equivalent to said plurality of rings, said channels being circularly shaped when viewed longitudinally, said channels being linearly positioned between said opposing ends of said cylinder, each said channel being selectively alignable with respective said indents positioned on a respective said ring;

a plurality of springs, each said spring being positioned in a respective said channel; and a plurality of balls, each said ball being positioned between a respective said spring and a respective said ring, such that said indents reversibly couple to said balls as said rings are rotated around said cylinder.

2. The device of claim 1, further including said plurality of rings comprising five said rings.

3. The device of claim 2, further including said plurality of rings comprising:

a set of three rings positioned sequentially adjacent to a respective said opposing end of said cylinder, said set of three rings comprising a first color;

a fourth ring positioned adjacent to said set of three rings, said fourth ring comprising a second color; and a fifth ring positioned between a respective said opposing end and said fourth ring, said fifth ring comprising a third color.

4. The device of claim 3, further including said first color being blue, said second color being red, and said third color being yellow.

5. The device of claim 1, further including said indicia being engraved.

6. The device of claim 3, further including said indicia comprising a fourth color.

7. The device of claim 6, further including said fourth color being black.

8. The device of claim 1, further including each of said plurality of facets comprising ten said facets.

9. The device of claim 8, further including said indicia coupled to each of said plurality of facets consisting of the set of numbers from zero to nine.

10. The device of claim 9, further including each said set of numbers from zero to nine being sequentially positioned on a respective said plurality of facets.

11. The device of claim 1, further including a pair of caps coupled singly to each said opposing end of said cylinder, said caps being substantially circumferentially complementary to said rings.

12. The device of claim 11, further including said caps being arcuate.

13. The device of claim 11, further including a coupler coupled to a respective said cap, said coupler being substantially centrally positioned on said respective said cap.

14. The device of claim 13, further including said coupler comprising a rod having opposing termini, each said opposing terminus being coupled to said cap.

15. The device of claim 14, further including a hoop coupled to said coupler, said hoop being circularly shaped, wherein said hoop is positioned through said coupler such that said hoop is configured for coupling to items of a user.

16. The device of claim 15, further including a key chain loop reversibly coupled to said hoop, wherein said key chain loop is configured for coupling to keys of the user.

17. The device of claim 15, further including a tag coupled to said hoop, wherein said tag is coupled to said hoop such that said tag is configured for labeling.

18. A random number generating device comprising:

a cylinder having opposing ends;

a plurality of rings rotationally coupled to said cylinder, said plurality of rings comprising five said rings, said plurality of rings comprising a set of three rings positioned sequentially adjacent to a respective said opposing end of said cylinder, said set of three rings comprising a first color, said plurality of rings comprising a fourth ring positioned adjacent to said set of three rings, said fourth ring comprising a second color, said plurality of rings comprising a fifth ring positioned between a respective said opposing end and said fourth ring, said fifth ring comprising a third color, said first color being blue, said second color being red, said third color being yellow;

indicia coupled to and arrayed linearly around an outer surface of each said ring, said indicia being engraved, said indicia comprising a fourth color, said fourth color being black;

each said ring comprising a plurality of facets, said indicia being coupled singly to each said facet, each of said plurality of facets comprising ten said facets, said indicia coupled to each of said plurality of facets consisting of the set of numbers from zero to nine, each said set of numbers from zero to nine being sequentially positioned on a respective said plurality of facets;

a plurality of indents, each said indent being positioned in an inner surface of a respective said ring, each said indent being positioned substantially equally distant from opposing edges of said respective said ring, each said indent being opposingly positioned relative to a respective said facet, said indents being semispherically shaped;

a plurality of channels positioned in said cylinder, said plurality of channels being numerically equivalent to said plurality of rings, said channels being circularly shaped when viewed longitudinally, said channels being linearly positioned between said opposing ends of said cylinder, each said channel being selectively alignable with respective said indents positioned on a respective said ring;

a plurality of springs, each said spring being positioned in a respective said channel;

a plurality of balls, each said ball being positioned between a respective said spring and a respective said ring, such that said indents reversibly couple to said balls as said rings are rotated around said cylinder;

a pair of caps coupled singly to each said opposing end of said cylinder, said caps being substantially circumferentially complementary to said rings, said caps being arcuate;

a coupler coupled to a respective said cap, said coupler being substantially centrally positioned on said respective said cap, said coupler comprising a rod having opposing termini, each said opposing terminus being coupled to said cap;

a hoop coupled to said coupler, said hoop being circularly shaped, wherein said hoop is positioned through said coupler such that said hoop is configured for coupling to items of a user;

a key chain loop reversibly coupled to said hoop, wherein said key chain loop is configured for coupling to keys of the user;

a tag coupled to said hoop, wherein said tag is coupled to said hoop such that said tag is configured for labeling; and wherein each said ball is positioned in a respective said channel such that a respective said spring motivates said ball into a respective said indent as a respective said ring is rotated around said cylinder, such that said respective said ball is reversibly coupled to said respective said indent, wherein each said ring is selectively rotatable around said cylinder, such that said rings are randomly positionable, wherein said indicia are arrayed in a plurality of parallel rows extending between said opposing ends of said cylinder, such that the user is presented with sequences of random numbers positioned in said rows.

* * * * *